United States Patent [19]

Burrows et al.

[11] Patent Number: 4,616,957

[45] Date of Patent: Oct. 14, 1986

[54] PIPELINE PADDING MACHINE

[76] Inventors: Larry N. Burrows, Rte. 7, Box 1542-C; Truman L. Gregory, Box 6605, both of Odessa, Tex. 79762

[21] Appl. No.: 619,311

[22] Filed: Jun. 8, 1984

[51] Int. Cl.[4] ..... E02F 5/22; F16L 1/02; F16L 57/00

[52] U.S. Cl. ..... 405/179; 405/157; 37/142.5; 414/528; 198/311

[58] Field of Search ..... 405/157, 179; 37/110, 37/142.5; 414/527, 528, 724, 725; 198/311

[56] References Cited

U.S. PATENT DOCUMENTS

| | | | |
|---|---|---|---|
| 3,443,836 | 5/1969 | Poltavtsev et al. | 37/142.5 X |
| 3,583,168 | 6/1971 | Horton | 405/179 |
| 3,596,384 | 8/1971 | Neujahr | 37/142.5 |
| 3,701,422 | 10/1972 | Downey | 37/142.5 X |
| 3,981,089 | 9/1976 | Burrows | 37/142.5 |
| 4,057,917 | 11/1977 | Burrows | 37/142.5 X |
| 4,301,910 | 11/1981 | Price | 405/179 X |
| 4,343,389 | 8/1982 | Ponstein | 405/179 X |
| 4,377,365 | 3/1983 | Layh | 37/142.5 X |

*Primary Examiner*—Cornelius J. Husar

*Assistant Examiner*—Nancy J. Stodola

*Attorney, Agent, or Firm*—Harvey B. Jacobson

[57] ABSTRACT

A machine for depositing pipeline padding material in a pipeline ditch in the form of an attachment for a bulldozer blade which is driven from the hydraulic system of the bulldozer and includes an endless conveyor belt forming the bottom of a horizontally oriented chute or trough which receives padding dirt from a dump truck body or the like and distributes it evenly in the pipeline ditch as the bulldozer with the padding machine mounted thereon moves alongside of the ditch. The padding machine includes a mounting structure attaching it to the bulldozer blade by utilizing hook-like frame members which open downwardly so that it can be dropped onto the bulldozer blade and a hydraulic drive motor and reduction gear is connected to the head pulley of the conveyor and is driven from a hydraulic pump associated with the bulldozer with control valve arrangements being provided for controlling the direction and speed of the conveyor in order to enable an even depth of padding material to be discharged into the ditch throughout its length.

2 Claims, 3 Drawing Figures

10
12
16
18
20
22
24
26
32
34
42
44
46
48
50
52
54
56
66
68
70
74
78
80
82
88
90

PIPELINE PADDING MACHINE

BACKGROUND OF THE INVENTION

1. Field of the Invention

The present invention generally relates to a machine for discharging padding dirt into a ditch to line the bottom of the ditch with padding dirt so that the pipeline may be placed thereon after which additional padding material may be placed on top of the pipeline to protect the pipeline from rocks and the like which may exist in the bottom or walls of the ditch and which may exist in conventional backfill dirt with the machine being attached to a bulldozer or similar vehicle and including an endless belt conveyor having a head pulley positionable alongside the open upper end of the ditch so that padding dirt or the padding material may be discharged into the ditch prior to laying the pipeline and also subsequent to laying the pipeline with the belt conveyor forming the bottom of a trough or chute which receives padding dirt from a dump truck or similar vehicle moving alongside of the ditch along with the bulldozer to which the padding machine is attached.

2. Description of the Prior Art

Padding machines have been previously used to place padding material such as clean fill dirt or the like into a ditch to provide a padding for a pipeline and also to cover the pipeline with a layer of padding material but such devices are relatively complicated and expensive when provided as a separate piece of equipment. The following U.S. patents are relevant to padding machines of this type:

U.S. Pat. No. 3,583,168—June 8, 1971
U.S. Pat. No. 3,596,384—Aug. 3, 1971
U.S. Pat. No. 3,981,089—Sept. 21, 1976
U.S. Pat. No. 4,301,910—Nov. 24, 1981
U.S. Pat. No. 4,377,365—Mar. 22, 1983

SUMMARY OF THE INVENTION

An object of the present invention is to provide a padding machine for placing padding material in a pipeline ditch which is in the form of an attachment for a bulldozer blade and which includes a conveyor for receiving padding material from a dump truck body or the like and discharging it into the pipeline ditch as the bulldozer and truck are driven alongside the ditch.

Another object of the invention is to provide a padding machine in accordance with the preceding object in which the conveyor is an endless belt-type conveyor driven by a hydraulic motor supplied power from the hydraulic system of the bulldozer with control valve arrangements being provided to drive the conveyor belt at selected speed in either direction.

A further object of the invention is to provide a padding machine in accordance with the preceding objects and in which the conveyor belt forms the bottom of an upwardly opening trough or chute which receives material from a dump truck body or the like and conveys it laterally for discharge into the pipeline ditch as the bulldozer is driven alongside the ditch with the conveyor projecting substantially laterally of the bulldozer to avoid the weight of the bulldozer causing collapse of the ditch.

A still further object of the invention is to provide a padding machine having a generally hook-shaped frame structure supporting the conveyor from a bulldozer blade with the hook-shaped frame structure opening downwardly for positioning over and mounting on the top edge of the bulldozer blade thereby enabling attachment of the padding machine to the bulldozer blade without alteration of the bulldozer other than the provision of hydraulic fluid hoses extending from the normally provided hydraulic pump on the bulldozer through control valves provided at the operator's position on the bulldozer.

Yet another feature of the invention is to provide a padding machine in the form of an attachment which enables an existing bulldozer to be utilized for placing padding material in a pipeline ditch thereby eliminating the necessity of having separate and independent equipment for this purpose with the padding machine being efficient in operation and easily controlled and also easily attached to and removed from the bulldozer when desired.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPMENT OF THE PREFERRED EMBODIMENT

Figure 3:
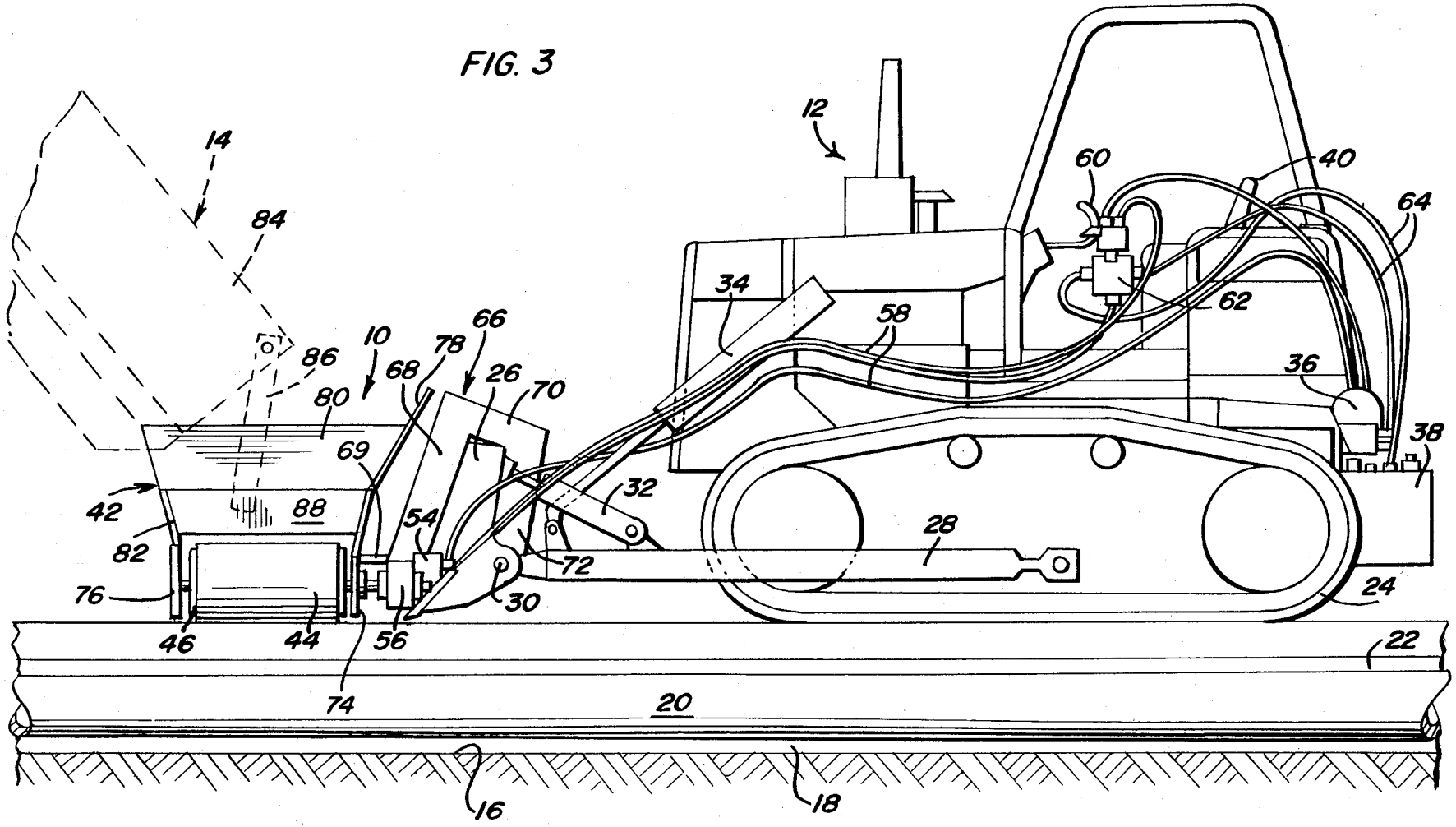
FIG. 3 is a side elevational view of the construction of the padding machine illustrating its association with a conventional bulldozer and dump truck.

Referring now to the drawings, the padding machine of the present invention is generally designated by the numeral 10 and, as illustrated in FIG. 3, is associated with a bulldozer 12 and a dump truck 14 for receiving padding material from the dump truck and depositing it in a pipeline ditch 16 so that a layer of padding material 18 may be placed in the ditch 16 in underlying relation to the pipeline 20 and also padding may be placed on top of the pipeline 20 with the overlying layer of padding material being designated by numeral 22. With this machine, padding material, such as clean dirt, sand or other material free of large rocks and the like may be placed in the ditch 16 with the layer of padding material being substantially the same thickness throughout the length and width of the ditch so that when the pipeline 20 is installed thereon, the pipeline 20 will be protected from underlying rock formations and the like. Similarly, after the pipeline has been installed, the covering padding material may be placed in the ditch after which the ditch may be backfilled by using a conventional bulldozer or similar type of machine to fill the ditch in a conventional manner. The bulldozer 12 is of conventional construction and includes the usual endless tracks 24 and forwardly disposed bulldozer blade 26 supported from a forwardly extending yoke 28 with the blade being pivotally about a transverse pivot axis 30 by hydraulic piston and cylinder assemblies 32 and being elevated and lowered by piston and cylinder assemblies 34 attached to the yoke 28, all in a conventional and well known manner. The bulldozer 12 also includes a hydraulic pump 36 communicated with a tank of hydraulic fluid 38 and an operators seat or control station 40 by which movement of the bulldozer 12 may be controlled in a conventional manner.

Figures 1, 2:
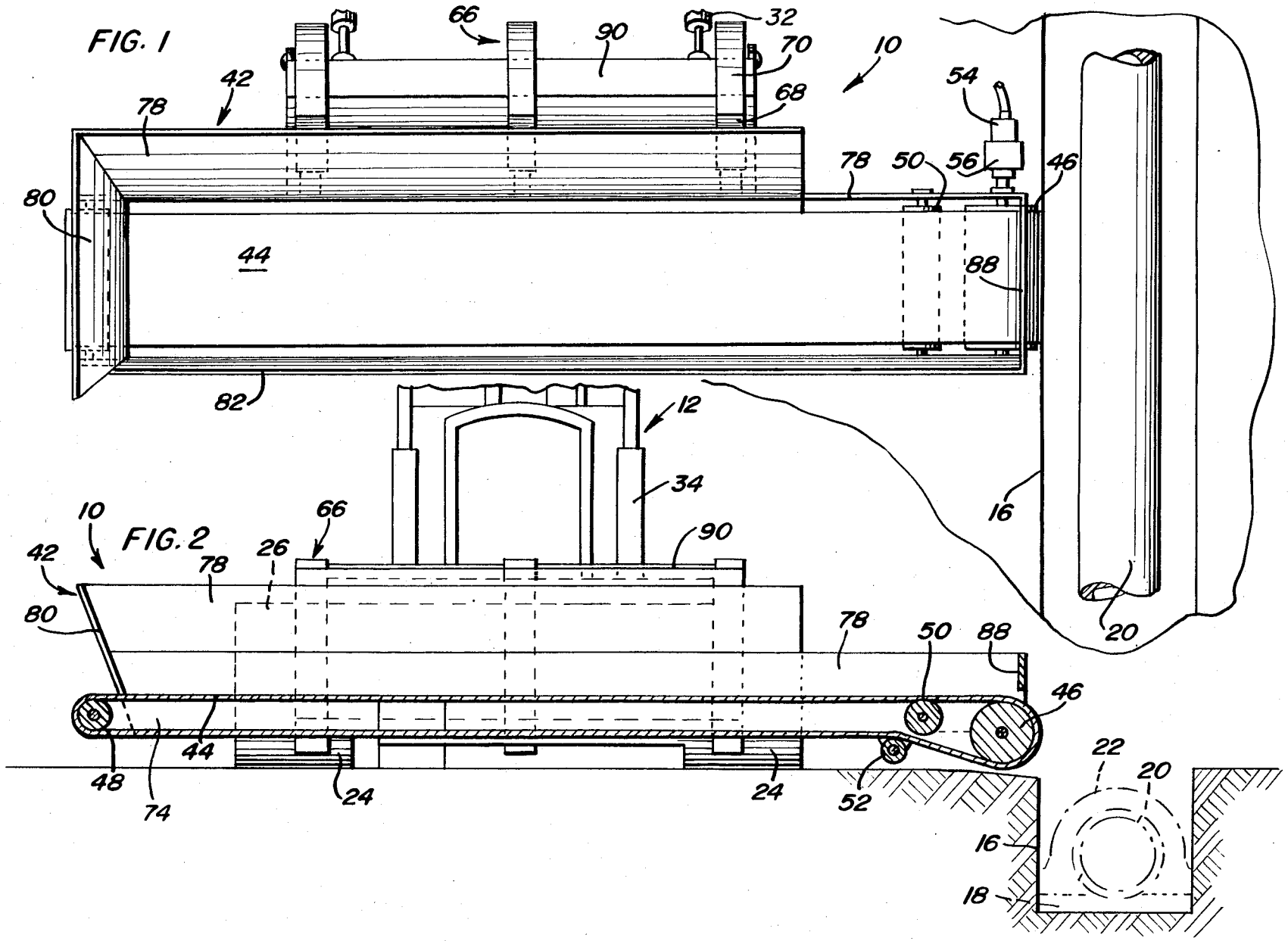
FIG. 1 is a top plan view of the padding machine of the present invention illustrating its association with the pipeline ditch.
FIG. 2 is a longitudinal sectional view of the padding machine illustrating the endless belt conveyor structure associated with the chute.

The padding machine of the present invention includes a horizontally disposed and upwardly opening chute generally designated by numeral 42 with the lower end of the chute 42 being closed by an endless conveyor belt 44 which extends throughout the length and width of the chute and which forms a bottom for the chute. The endless belt 44 is entrained over a head pulley 46 at one end thereof and a tail pulley 48 at the other end thereof with the head pulley 46 being spaced further from the longitudinal center line of the bulldozer and padding machine than the tail pulley 48 as illustrated in FIG. 2 so that the head pulley 46 can be approximately aligned with the adjacent sidewall of the ditch 16 as illustrated in FIG. 2 so that padding material may be discharged tangentially from the head pulley and the belt which encircles the head pulley into the ditch. The belt 44 adjacent the head pulley 46 is provided with a roller 50 underlying the upper run of the belt 44 and a roller 52 underlying the lower run of the belt 44 to prevent the belt from sagging and maintaining the belt above the lower edge of the bulldozer blade. The upper flight of the belt 44 may be supported by a slider bed or roller bed construction which, of course, will prevent downward deflection of the belt when padding material is discharged into the chute 42 from the dump truck 14.

The head pulley 46 is driven by a hydraulic motor 54 and a reduction gear unit 56 connected drivingly to the shaft of the head pulley 46 with the motor 54 being connected with hydraulic conduits 58 which extend to a speed control valve 60 and a direction control valve 62 located at the operator's station 40 and connected with the pump and hydraulic tank through hydraulic conduits 64 in a conventional manner so that the operator of the bulldozer can control the speed of movement of the conveyor belt 44 and also control the direction of movement of the conveyor belt 44.

The padding machine is supported from the bulldozer blade 26 by a plurality of supporting frame assemblies 66 each of which includes a front frame member 68 oriented in front of and engaging the front surface of the bulldozer blade and a top frame 70 which extends rearwardly and overlies and engages the top edge of the bulldozer blade and a depending rear frame 72 spaced from the front frame 68 which extends downwardly alongside of and engaging with the rear surface of the bulldozer blade 26 thereby connecting the supporting frame assemblies 66 to the bulldozer blade 26 by merely dropping them down onto and over the bulldozer blade 26. The supporting frame assemblies 66 are connected with side frame members 74 and 76, which are rigidly interconnected by brackets 69 in a manner to securely support the conveyor belt, rollers and pulleys and chute from the frame assemblies 66. As illustrated in FIG. 1, the supporting frame assemblies 66 include three longitudinally spaced frame assemblies en-gaging the bulldozer blade 26 in a secure and positive manner.

The chute 42 includes a rear wall 78, an end wall 80 adjacent the tail roller or pulley 48 and a front wall 82, all of which incline upwardly with the front wall 82 being of less height than the rear wall and end wall to enable a dump truck body 84 to be positioned in overlying relation to the upwardly opening chute for discharge of material into the chute when the tailgate 86 of the dump truck body 84 is opened to a vertical position when the dump truck body 84 is upwardly inclined as illustrated in FIG. 3. The rear wall 78 includes an upper component which is angled in relation to a lower component with the lower component extending beyond the end of the upper component as illustrated in FIG. 2 with the front wall also extending to the same extent. The walls 78 and 82 are interconnected by an end wall 88 which is spaced slightly above the belt to provide a relatively thin but constant thickness layer of material for discharge from the end of the conveyor belt.

With this invention, a bulldozer may be converted to a padding machine by merely dropping the padding machine attachment 10 of the present invention onto the bulldozer blade and connecting the hydraulic drive and control unit with the existing hydraulic system on the bulldozer. Then by driving the bulldozer along side of the ditch 16 and receiving material into the chute 42, a layer of padding material may be accurately and efficiently discharged into the ditch 16. The lateral spacing of the head pulley or roller from the bulldozer 12 enables the bulldozer tracks to engage soil surfaces substantially spaced from the ditch thereby avoiding any possibility of the ditch collapsing due to weight of the bulldozer. The end wall 88 prevents excessive padding material from being dumped into the ditch and assures that a substantially even thickness of padding material is discharged from the conveyor and thus placed in the ditch so that the bulldozer may progress along the ditch at substantially a constant speed. Thus, no special machine must be purchased, leased or otherwise obtained to properly place padding into a pipeline ditch before the pipeline is laid and after the pipeline is laid.

The dimensional characteristics of the device may vary but in one embodiment of the invention, the overall length of the conveyor from head pulley to tail pulley may be 16 feet with the device being attached to an 8 foot bulldozer blade. The supporting frame 66 is preferably provided with connector bars 90 between the three frame assemblies to provide a rigid unit that will be maintained in assembled relation even when disconnected from the bulldozer blade. The conveyor belt 44 may have a width of 30 inches so that standard components may be utilized in constructing the machine. The conveyor assembly may be a conventional slider bed or roller bed belt type conveyor with the details of the conveyor being well known and not shown in detail. The chute structure has been specifically adapted for this use. As an alternative to mounting the machine from the bulldozer blade, a bracket and pin kit can be used so that the bulldozer blade can be removed and the padding machine connected directly to the yoke 28 as at 30 and to the piston and cylinder assemblies 32. The dump truck is pushed by the padding machine and vehicle 12 with U-shaped push bars attached to forward frame member 74 and engage with the truck frame or body. The push bars are not shown as they are substantially conventional in construction.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A machine for transfering padding material from a dump truck body into a pipe line ditch comprising an elongated, horizontally disposed, upwardly opening chute for receiving padding material from the dump truck body, an endless, imperforate, flexible conveyor belt forming the bottom of said cute, said chute including an end wall spaced a predetermined distance above the belt to form a slot-like outlet above the belt, a pair of end rollers supporting said belt for discharge of padding material into a ditch with the thickness of the padding material being discharged determined by the space between the end wall and the conveyor belt and remaining substantially constant as padding material is discharged into the ditch, means driving one of said end rollers, means mounting the chute, belt and rollers from a vehicle such that as the vehicle travels parallel to a pipeline ditch, padding material will be discharged into the ditch, said means supporting the chute, belt and rollers from a vehicle includes a supporting frame structure of inverted U-shaped configuration for vertically positioning on a bulldozer blade attached to the vehicle without modification of the bulldozer blade and without manipulation of fastening devices, said chute including an upwardly inclined rear wall being inclined toward the frame structures, an upwardly inclined front wall of less height that the rear wall thereby enabling the rear end of a dump truck body to be positioned over the front wall of the chute for discharging padding material into the chute without contacting the front wall.

2. An apparatus for transferring padding material from a dump truck body into a pipeline ditch comprising a bulldozer having a front mounted bulldozer blade, a plurality of downwardly opening hook-like mounting structures positioned vertically downwardly over the top edge of the bulldozer blade, a chute and conveyor assembly attached to said mounting structures and including a vertical dimension generally equal to the mounting structures and bulldozer blade, said chute including upwardly extending, outwardly inclined peripheral wall portions including an end wall spaced laterally of the end of the bulldozer blade and positionable alongside of a pipeline ditch as the bulldozer is driven parallel to the ditch in spaced relation thereto, said conveyor including an endless conveyor belt forming the bottom of the chute and extending from end to end thereof and including end rollers supporting the belt, a hydraulic motor driving one of the end rollers and powered from the hydraulic system of the bulldozer with one of the end rollers being positioned closely adjacent and under the end wall to provide a slot-like discharge outlet between the upper flight of the conveyor belt and the end wall to restrict the discharge of padding material into a substantially constant thickness layer of padding material for discharge into the ditch thereby providing a substantially constant thickness layer of padding material in the ditch as the bulldozer is driven parallel to the ditch.

* * * * *